US012173383B2

(12) United States Patent
Swensen et al.

(10) Patent No.: US 12,173,383 B2
(45) Date of Patent: Dec. 24, 2024

(54) ULTRA-HIGH TEMPERATURE CONTINUOUS REDUCTION OF METAL COMPOUND PARTICLES WITH SUBSEQUENT SELECTIVE SEPARATION

(71) Applicant: Omnis Advanced Technologies, LLC, Santa Barbara, CA (US)

(72) Inventors: James S. Swensen, Santa Barbara, CA (US); Simon K. Hodson, Santa Barbara, CA (US)

(73) Assignee: Omnis Advanced Technologies, LLC, Santa Barbara, CA (US)

( * ) Notice: Subject to any disclaimer, the term of this patent is extended or adjusted under 35 U.S.C. 154(b) by 0 days.

(21) Appl. No.: 18/371,330

(22) Filed: Sep. 21, 2023

(65) Prior Publication Data

US 2024/0093329 A1 Mar. 21, 2024

Related U.S. Application Data

(60) Provisional application No. 63/408,730, filed on Sep. 21, 2022.

(51) Int. Cl.

| | |
|---|---|
| ***C22B 5/10*** | (2006.01) |
| ***C22B 5/12*** | (2006.01) |
| ***C22B 5/16*** | (2006.01) |
| ***C22B 7/02*** | (2006.01) |
| ***C22B 59/00*** | (2006.01) |

(52) U.S. Cl.

CPC ..... *C22B 5/10* (2013.01); *C22B 5/12* (2013.01); *C22B 5/16* (2013.01); *C22B 7/02* (2013.01); *C22B 59/00* (2013.01)

(58) Field of Classification Search

CPC .... C22B 5/10; C22B 5/12; C22B 5/16; C22B 7/02; C22B 59/00

See application file for complete search history.

(56) References Cited

U.S. PATENT DOCUMENTS

| | | | |
|---|---|---|---|
| 4,678,647 | A | 7/1987 | Lisowyj et al. |
| 4,822,410 | A | 4/1989 | Matovich |

(Continued)

FOREIGN PATENT DOCUMENTS

| | | | |
|---|---|---|---|
| EP | 0963452 | B1 | 10/2001 |
| GB | 2038880 | B | 1/1983 |

*Primary Examiner* — Adil A. Siddiqui

(74) *Attorney, Agent, or Firm* — KIRTON McCONKIE; Evan R. Witt

(57) ABSTRACT

A continuous process for converting metal compound particles into a mixture of elemental metals. Metal compound particles and a reductant are introduced into an ultra-high temperature reaction zone having a temperature greater than 2,700° C. and an oxygen content less than 3 vol. %. The metal compound particles have particle sizes of d90 500 μm. The metal compound particles have a residence time less than 1 minute in the ultra-high temperature reaction zone sufficient to mix with and react with the reductant to reduce the metal compound particles to form a mixture of elemental metals. The mixture of elemental metals is removed from the ultra-high temperature reaction zone. One or more elemental metals are separated or concentrated from the mixture of elemental metals within one or more separation zones based on differential size and density of the one or more elemental metals and the remaining mixture of elemental metals.

22 Claims, 7 Drawing Sheets

(56) References Cited

U.S. PATENT DOCUMENTS

2004/0060387 A1* 4/2004 Tanner-Jones ..... C22B 5/02
75/10.2
2009/0308204 A1* 12/2009 Kooij ..... C21B 13/146
75/448

* cited by examiner

ULTRA-HIGH TEMPERATURE CONTINUOUS REDUCTION OF METAL COMPOUND PARTICLES WITH SUBSEQUENT SELECTIVE SEPARATION

CROSS-REFERENCE TO RELATED APPLICATION

This application claims the benefit of U.S. Provisional Application No. 63/408,730, filed Sep. 21, 2022, and entitled ULTRA HIGH TEMPERATURE PYROLYSIS REDUCTION AND SUBLIMATION OF MINERALS WITH SUBSEQUENT SELECTIVE CONDENSATION SEPARATION. The prior application is incorporated by reference.

BACKGROUND OF THE INVENTION

The disclosure relates to a continuous process to convert metal compound particles into a mixture of elemental metals using an ultra-high temperature reduction process. The disclosure further relates to a process for selectively separating or concentrating one or more elemental metals from the mixture of elemental metals.

Processing of minerals or metal ore into the corresponding elemental metal has been done for centuries. Minerals or metal ore often include one or more oxides or hydroxides of the metal. Two examples of minerals or metal ore are naturally occurring bauxite ($Al(OH)_3$) and hematite ($Fe_2O_3$), from which are produced two of the most used metals on the planet. There are four main methods to convert metal ores into the elemental metal. Electrolytic reduction, carbothermic reaction, CO reduction of the metal ores, and hydrogen reduction of metal ores. Aluminum and copper ores are usually processed via electrolytic reduction to their elemental metals. Iron ore is usually processed via carbothermic reaction coupled with CO reduction in a blast furnace. The reactivity of the metal determines the method by which a metal ore is usually reduced to the elemental metal form. Metals which are more reactive than carbon are processed via electrolytic reduction. Metals which are less reactive than carbon can be reduced to the elemental metal by carbothermic reaction.

Many commonly used metals have well-developed processing methods and large markets to accept them. An increasingly important need is the processing of less common metals that are of high value, namely rare earth element (REE) metals, high value transition metals, and other high value metals and semimetals. Rare earth elements are used in catalysts, permanent magnets, glass, metallurgy, batteries, ceramics, pigments, phosphors, electronic devices, photovoltaics, military applications, and more. Indium is an example of a critical metal whose supply struggles to meet demand as a major component of transparent electrodes used in phone and computer displays and other applications. Lithium is an example of a valuable alkaline metal because of the ever-increasing demand for lithium-ion batteries. Reduced alkali metals and alkaline earth metals will remain in their elemental state and not oxidized if kept in an oxygen depleted environment.

Ore is a naturally occurring solid material from which a metal or valuable mineral can be extracted. An ore may be rock or powder minerals that contain one or more metal oxides or minerals of one or more metals. A mineral of a metal is a compound of the metal, meaning the metal is not in its elemental state. Iron ore is commonly thought of as iron oxide ($Fe_2O_3$). Another mineral containing iron is pyrite ($FeS_2$). Rare earth element (REE) metals, transition metals, and other valuable and critical metals are usually found as oxide ores or other mineral forms in dilute amounts as rocks, mineral powders, or in other metal ores. Using rare earth element metals as an example, the common process for recovering rare earth elements is:

- Crush the rocks, ore, mineral source as needed to liberate the particles containing the REE metals from the matrix.
- Perform a flotation process to concentrate the particles that contain REE metals.
- Dissolve the oxide and mineral particles that contain the REE metals from the flotation concentrate.
- Perform solvent extraction techniques to isolate the targeted REE metals from the bulk solution.
- Precipitate the targeted REE metal from solution.
- If the purified target REE metal precipitate is the target material, then the process is done. A precipitate that is a final product is usually an oxide or salt of the target REE metal.
- If the elemental REE metal is the target material, then further processing is required to convert the purified REE metal precipitate to the purified REE elemental metal. Since REE oxides are stable, reduction to the elemental metal is difficult.
  - The most common method is a multi-step chloride reduction process which produces significant toxic waste.
  - Molten salt electrorefining methods, similar to the aluminum production process, are under investigation.

In summary, critical, strategic, and rare earth element metals are an important and growing component of high-performance electronics and other industrial materials. These metals are typically extracted with acids resulting in a very large volume of acid leach waste material that is very damaging and costly. Further, this acid extraction method has a very low efficiency.

A more rapid, more economical, and less waste producing method to extract rare earth element metals, transition metals, and other valuable metals from bulk mineral deposits would be an advancement in the art.

Fine particle waste produced when mining coal is a significant environmental concern. In the US and other countries, the fine particle waste from mining coal is disposed of in slurry impoundments. A Washington Post article, "Many coal sludge impoundments have weak walls, federal study says," (https://www.washingtonpost.com/national/health-science/many-coal-sludge-impoundments-have-weak-walls-federal-study-says/2013/04/24/76c5be2a-acf9-11e2-a8b9-2a63d75b5459_story.html) quoted the Mine Safety and Health Administration saying there are 596 slurry impoundments in 21 states. These impoundments sites represent millions of tons of fine particle waste. Potential environmental issues include dam failure and mudslides and slurry slides down into valleys, rivers, roads, and communities, groundwater contamination from dissolved and suspended solids, acid water drainage into groundwater and surface water, etc.

There are about 430 coal ash ponds (https://insideclimatenews.org/news/29062009/epa-releases-secret-list-44-high-risk-coal-ash-ponds/) that store the ash produced from burning coal around the U.S.A. with similar environmental concerns. The EPA reports there 1,000 coal ash storage sites (https://www.alleghenyfront.org/the-cautionary-tale-of-the-largest-coal-ash-waste-site-in-the-u-s/), which include ponds that store wet waste or landfills that store dry waste.

There are ash storage sites found worldwide filled with solid waste produced from burning coal.

A new process to clean or remediate these slurry ponds and waste sites associated with fine particle coal waste and coal ash waste and which also extracts value from the waste sites would be of both and environmental and economic benefit.

SUMMARY OF THE INVENTION

The disclosed invention relates to a continuous process for converting metal compound particles into a mixture of elemental metals. The disclosed invention further relates to a process for selectively separating or concentrating one or more elemental metals from the mixture of elemental metals.

In the disclosed reduction process, metal compound particles and a reductant are introduced into an ultra-high temperature reaction zone.

The metal compound particles have a residence time in the ultra-high temperature reaction zone sufficient to mix with and react with the reductant to reduce the metal compound particles to form a mixture of elemental metals. In some embodiments, the residence time is less than 1 minute. In some embodiments, the residence time is less than 50 seconds, 40 seconds, 30 seconds, 25 seconds, 20 seconds, 18 seconds, 16 seconds, 14 seconds, 12 seconds, 10 seconds, 9 seconds, 8 seconds, 7 seconds, 6 seconds, 5 seconds, 4 seconds, 3 seconds, 2 seconds, and 1 second.

The ultra-high temperature reaction zone may operate at a temperature greater than 2,700° C. In some embodiments, the ultra-high temperature reaction zone may operate at a temperature greater than 2,500° C. In some embodiments, the ultra-high temperature reaction zone may operate at a temperature greater than 2,000° C. In some embodiments, the ultra-high temperature reaction zone may operate at a temperature greater than 1,850° C. In some embodiments, the ultra-high temperature reaction zone may operate at a temperature in a range from 1850° C. to 3000° C.

The ultra-high temperature reaction zone may have an oxygen-depleted or oxygen deprived environment. The ultra-high temperature reaction zone may have an oxygen content less than 3 vol. %. In some embodiments, the oxygen content may be less than 2 vol. %. In some embodiments, the oxygen content may be less than 1 vol. %. In some embodiments, the oxygen content may be less than 0.5 vol. %. In some embodiments, the oxygen content may be less than 0.2 vol. %. In some embodiments, the oxygen content may be less than 0.1 vol. %.

The metal compound particles have particle sizes less than 1 mm. In some embodiments, the metal compound particles have particle sizes of d90 500 μm. The metal compound particles have particle sizes of d90 200 μm. The metal compound particles have particle sizes of d90 100 μm. The metal compound particles have particle sizes of d90 50 μm. Particle sizes may be determined in one or more conventional ways, such as sieves or particle size analyzers, including laser diffraction particle size analyzers.

In the reduction process, gases, vapors, liquids, and/or entrained solid particles comprising the mixture of elemental metals are removed from the ultra-high temperature reaction zone.

One or more elemental metals may be separated from the mixture of elemental metals within one or more separation zones based on differential physical characteristics of the one or more elemental metals and the remaining mixture of elemental metals. In some embodiments, the differential physical characteristics include differences in size and density.

The metal compound particles comprise chemical derivatives of one or more metal elements or semimetal elements, where the metal elements or semimetal elements are ionically bonded to another atom and/or covalently bonded to another atom. In some non-limiting embodiments, the metal compound particles comprise one or more minerals, aggregates of minerals, metal oxides, metal hydroxides, and/or metal salts. In some non-limiting embodiments, the metal compound particles comprise one or more rare earth metals. In some non-limiting embodiments, the metal compound particles comprise one or more transition metals.

The metal compound particles may comprise fine particle coal waste from a mine or a mining process. The metal compound particles may comprise coal ash waste.

The reductant may comprise carbon particles. The carbon particles may the have a particle size of d90 10 μm. The carbon particles may have a particle size of d90 5 μm. The carbon particles have a particle size of d90 1 μm. The carbon particles have a particle size of d50 100 nm.

The reductant may comprise hydrogen gas. The reductant may comprise carbon monoxide. The reductant may comprise a hydrocarbon. The hydrocarbon may comprise coal. The hydrocarbon may comprise natural gas. The hydrocarbon may comprise a liquid hydrocarbon. The reductant may comprise at least two reductants selected from hydrogen gas, carbon monoxide gas, or natural gas.

The ultra-high temperature reaction zone with oxygen depleted environment may comprise combustion gas exiting a pulse combustor.

The disclosed invention further relates to a process for separating one or more elemental metals from a mixture of elemental metals produced via ultra-high temperature reduction of metal compound particles. In an embodiment of the process, the mixture of elemental metals have a temperature greater than 1850° C. The mixture of elemental metals is disposed within a first cyclone operating at a first cyclone temperature to separate one or more elemental metals from a remaining mixture of elemental metals based on a differential size and/or density of the one or more elemental metals and the remaining mixture of elemental metals.

In an embodiment of the process, the remaining mixture of elemental metals is disposed within a second cyclone operating at a second cyclone temperature to separate one or more further elemental metals from a further remaining mixture of elemental metals based on a differential size and/or density of the one or more further elemental metals and the further remaining mixture of elemental metals.

In an embodiment of the process, the further remaining mixture of elemental metals is disposed within one or more subsequent cyclones connected in series and operating at different cyclone temperatures to separate one or more subsequent elemental metals from a subsequent remaining mixture of elemental metals based on a differential size and/or density of the one or more subsequent elemental metals and the subsequent remaining mixture of elemental metals.

In an embodiment of the process, a temperature reduction of the remaining mixture of elemental metals occurs between the first cyclone and the second cyclone. In an embodiment of the process, the temperature reduction is accomplished with a heat exchanger. In an embodiment of the process, the temperature reduction is accomplished by introducing a spray of liquid nitrogen. In an embodiment of the process, the temperature reduction is accomplished by introducing a spray of water.

In one or more embodiments of the process, the first cyclone temperature equilibrates to the temperature of the incoming mixture of elemental metals.

The terminology used herein is for the purpose of describing particular embodiments only and is not intended to be limiting. In this specification and in the claims that follow, reference will be made to a number of terms, which shall be defined to have the definitions set forth herein. Unless otherwise defined, all technical and scientific terms used herein have the same meaning as commonly understood by one of ordinary skill in the art to which this invention belongs. The singular forms also include the plural unless the context clearly dictates otherwise. Thus, the singular forms "a," "an" and "the" include plural referents unless the context clearly dictates otherwise.

As used herein, the expression [A], [B], [C], "and/or" [D] means that one or more of the cases connected by the expression "and/or" may occur individually or in combination. Thus, the expression means [A] or [B] or [C] or [D] may occur individually, or combinations of any two or more cases may occur, such as [A] and [B], [A] and [C], [B] and [C], [A], [C], and [D], etc.

As used herein, unless explicitly stated otherwise or clearly implied otherwise, the term "about" refers to a range of values plus or minus 10 percent ("±10%"), e.g., about 1.0 encompasses values from 0.9 to 1.1.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include the individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the range or the characteristics being described.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. Additionally, while the following description refers to several embodiments and examples of the various components and processes of the described invention, all of the described embodiments and examples are to be considered, in all respects, as illustrative only and not as being limiting in any manner. Furthermore, the described features, structures, characteristics, processes, or methods of the invention may be combined in any suitable manner in one or more embodiments.

It is to be understood that both the foregoing general description and the following detailed description are exemplary and explanatory and are not restrictive of the invention, as claimed. It is understood that specific aspects and features of the disclosed invention may be freely combined with other specific aspects and features of the disclosed invention. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DESCRIPTION OF THE INVENTION

Figure 1:
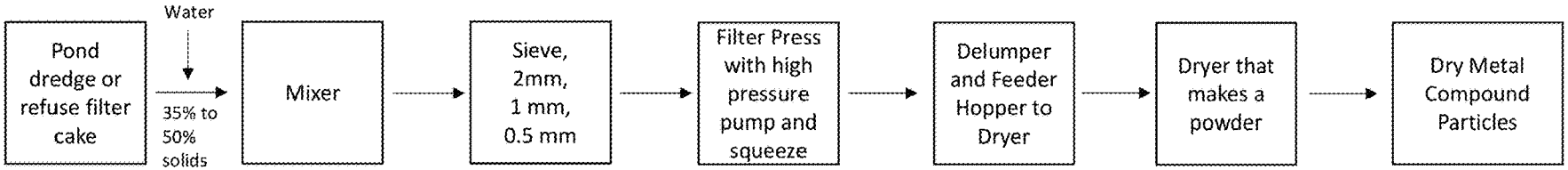
FIG. 1 shows a process flow that represents a non-limiting embodiment of equipment which could prepare fine particle waste from coal mine impoundments or coal ash impoundments.

This disclosure relates to a continuous process to convert metal compound particles into a mixture of elemental metals using an ultra-high temperature reduction process. This disclosure further relates to a process for selectively separating or concentrating one or more elemental metals from the mixture of elemental metals.

As used herein, metal compound particles comprise one or more minerals, aggregates of minerals, metal oxides, metal hydroxides, and/or metal salts. The metal compound particles comprise chemical derivatives of one or more metal elements or semimetal elements, where the metal elements or semimetal elements are ionically bonded to another atom and/or covalently bonded to another atom. In short, the metal element is a compound with another element or elements and not in the pure, elemental state.

The disclosed process introduces metal compound particles and a reductant present in an ultra-high temperature reaction zone to rapidly heat the metal compound particles and reductant under conditions where the metal compound particles and reductant chemically react.

As used herein, a reductant is a reducing agent or a substance capable of bringing about the reduction of another substance as itself is oxidized. As used herein, the term reductant also includes indirect reductants which serve indirectly as reductants because they are converted within the reaction zone into one or more reductants. Non-limiting examples of reductants include carbon particles, hydrogen gas, carbon monoxide gas, and hydrocarbons. Hydrocarbons may be solid, liquid, or gaseous hydrocarbons. A nonlimiting solid hydrocarbon is coal. A nonlimiting gaseous hydrocarbon is compressed natural gas (CNG).

The ultra-high temperature reaction zone comprises an oxygen-depleted or oxygen deprived environment. As used herein, the terms oxygen depleted, oxygen deprived, or very low excess oxygen mean less than about 3 vol. %, 2 vol. %, 1 vol. %, 0.5 vol. %, 0.2 vol. %, 0.1 vol. % $O_2$, where any of the stated values can form an upper or lower endpoint of a range.

As used herein, the term residence time means an exposure time of the metal compound particles and reductant to the ultra-high temperature reaction zone and its oxygen depleted environment. The metal compound particles and reductant have a residence time in the ultra-high temperature reaction zone less than about 1 minute. The entire residence time of the metal compound particles and reductant to the ultra-high temperature reaction zone may be greater than a second due to transport time within process system equipment. The residence time may be less than 60 seconds, 50 seconds, 40 seconds, 30 seconds, 25 seconds, 20 seconds, 18 seconds, 16 seconds, 14 seconds, 12 seconds, 10 seconds, 9 seconds, 8 seconds, 7 seconds, 6 seconds, 5 seconds, 4 seconds, 3 seconds, 2 seconds, and 1 second, where any of the stated values can form an upper or lower endpoint of a range.

In an embodiment where the reductant comprises carbon particles, the carbon reacts with the metal compound particles to cause an immediate reduction of the metal compound particles into one or more elemental metals and carbon monoxide. The carbon will preferentially scavenge the oxygen from the metal compound particles making carbon monoxide and elemental metal. Carbon monoxide can then react with a different metal compound to reduce it to elemental metal. The combined metal molecules will separate into their individual metal components. The elemental metals are preferentially maintained in a vapor or liquid state to facilitate separation and recovery.

The carbon may be a char inherently present in a coal ash sample. The carbon may be an additive blended with the metal compound particles prior to processing. In this case, the carbon may be char particles, coke particles, graphite particles, biochar particles, and/or carbon black, and/or carbon black-like particles called microcarbon particles described in U.S. Pat. No. 11,505,464 B2. The size of the carbon particles may be d90 50 microns. The size of the carbon particles may be d90 10 micron. The size of the carbon particles may be d90 1 micron. The size of the carbon particles may be d90 0.2 micron.

The gas and/or liquid stream containing sublimated metal gas or liquid metal or a mixture of gas and liquid metal can then be cooled in a series of chambers that will cause a condensation of selective metals according to their specific boiling/condensation points but above their melting points so that the metals condense in a molten state and can be collected at the bottom of the chamber/cyclone. The remaining uncondensed gases can then proceed to a second and third and fourth chamber with successive cooler surfaces/environments to cause the condensation of progressively lower boiling point metals. Further separation of metals can occur in the molten state according to the differences in density.

This system and process can allow the high efficiency and rapid refining of metals and separation/recovery of metals from minerals including critical metals, rare earth metals, transition metals, and/or specialty metals.

Fine particle waste found at coal mine impoundments or coal ash impoundments are ideal feed material candidates for the process described herein.

FIG. 1 shows a process flow that represents a non-limiting embodiment of equipment which could prepare fine particle waste from coal mine impoundments or coal ash impoundments to be used in the ultra-high temperature reduction and separation of metal compounds process described herein. A dredge could be used to mine the slurry pond and make an initial slurry out of the settled solids in the slurry. Alternatively, wet filter cake, dry filter cake, or dry slurry pond solids could be dredged or put directly into a metering system that takes them to a mixer where a slurry of about 30 to 50 wt. % solids could be made. The impoundment site may have larger particles blended with the fine particle waste that are not a desirable feedstock for the ultra-high temperature reduction of metal compound particles. The oversized particles may be separated from the slurry with a 2 mm sieve. In another embodiment, a 1 mm sieve is used. In another embodiment a 0.5 mm sieve could be used. In another embodiment, hydrocyclone(s) could be used to size and separate fine particle waste from larger solids that are undesirable for the process. The oversized material, such as retains on the sieve or underflow from the hydrocylones(s), are set aside. If oversized material has value as coal or aggregate, the material could be sold into those markets. The material might be milled and added back to the mixer.

In one embodiment, the particles have a size of d90 0.5 mm. In other embodiments, the particles have a size of d90 0.2 mm. In other embodiments, the particles have a size less of d90 0.1 mm. In another embodiment, the particles have a size of d90 0.05 mm.

Particle sizes and particle size distributions disclosed herein may be measured using a sieve analysis technique or a commercially available particle size analyzer, such as a laser diffraction particle size analyzer. Particle size distributions may be used to determine an average particle size, a median particle size, and other distribution defining terms. As used herein and unless specifically defined otherwise, the term "particle size" refers to median particle size or a "d50" size on a particle size distribution. The term "d50" size value means that 50% of the particles in the sample are smaller than the size value. Thus, d50, by definition, is the median particle size. More generally, "dXX" size value means that XX % of the particles in the sample distribution are smaller than the size value. Particle sizes of d90 and d99 are also referenced herein. For example, a particle size of d99 200 microns (XX=99 and "size value"=200 microns) means 99% of the particles have a size below 200 microns. While a particle size of d50 indicates a median particle size, a particle size of d99 indicates an upper limit particle size.

The filtered slurry may be dewatered in a filter press with a high-pressure pump, such as a piston or screw pump. A high-pressure squeeze step may then be used to further dewater the filter cake. A filter cake of about 15 to 25 wt. % solids exits the filter press. The filter cake is metered through a delumper and into a dryer that produces a powder from the de-lumped filter cake. The dry and powdered fine particle coal waste from a coal mine impoundment or from a coal ash impoundment (e.g., ash produced at a coal fired power plant) enters the hopper for the feeder of the ultra-high temperature reduction process. The dry and powdered fine particles made from the fine particle coal waste produced by a coal prep plant, e.g., from a slurry pond, impoundments, etc., may have an ash content around 50 wt. % ash and 50 wt. % coal. The value varies depending on the efficiency of the equipment of the coal prep plant. The dry and powdered fine particle waste from a coal ash impoundment site may have no carbon in it at all since it was the product of burning coal. It may have some unburned carbon char in the ash. The carbon content is likely less than 20 wt. %.

Figure 2:
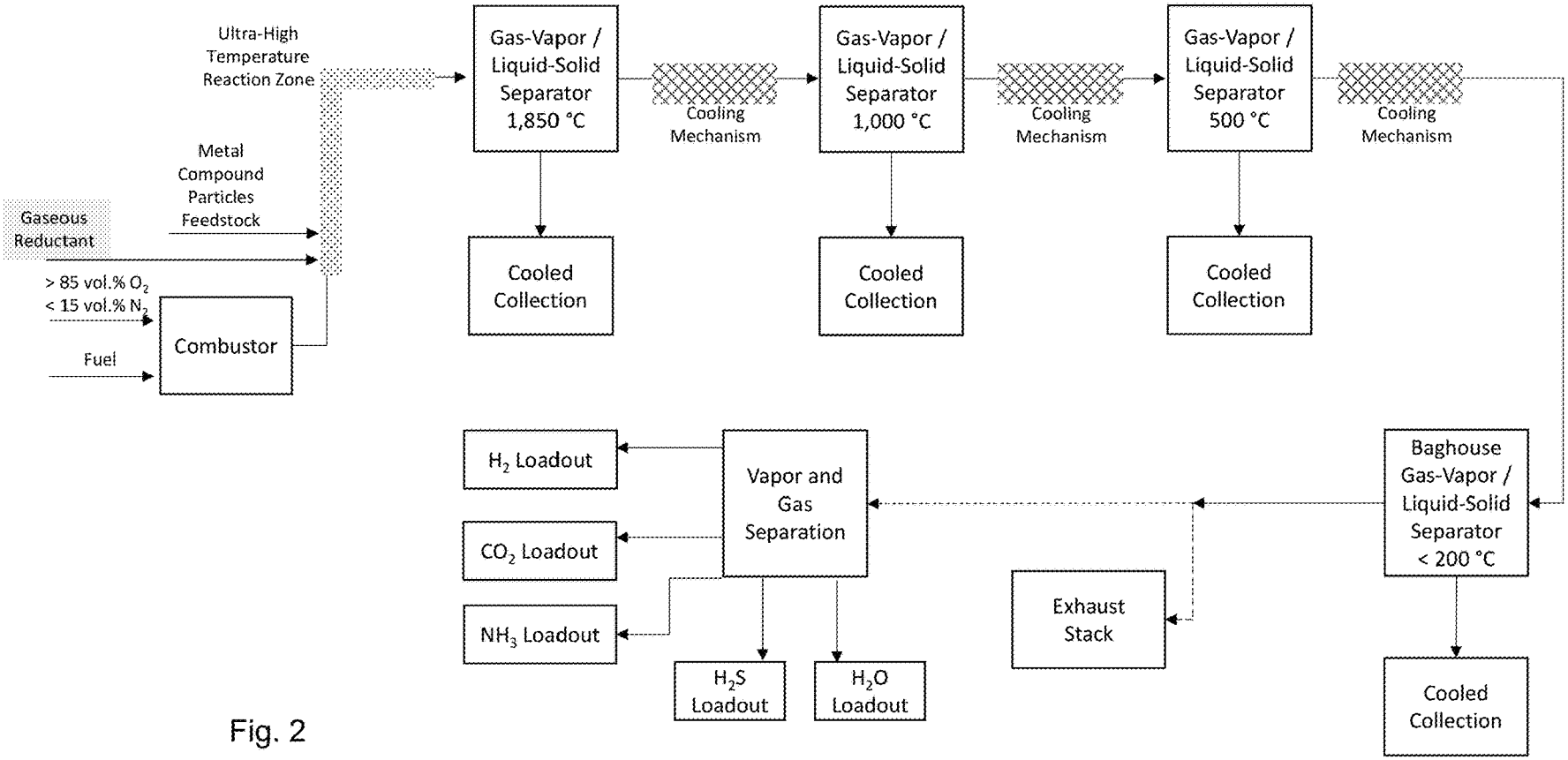
FIG. 2 is an all-inclusive flow chart showing various non-limiting iterations, combinations, and variations of the disclosed invention.

FIG. 2 is an all-inclusive flow chart showing various non-limiting iterations, combinations, and variations of the disclosed invention.

A combustor burns fuel and an oxygen containing gas to produce an ultra-high temperature and oxygen depleted gas stream which is the environment or conditions of the ultra-high temperature reaction zone where the ultra-high temperature reduction of metal compounds takes place. The oxygen content in the oxygen containing gas stream is concentrated, and preferably greater than 85 vol. %. In some embodiments, the oxygen content in the oxygen containing gas stream is greater than 90 vol. %. In some embodiments, the oxygen content in the oxygen containing gas stream is greater than 92 vol. %. Almost all of the remaining gas in the oxygen containing gas stream is nitrogen if the oxygen was concentrated out of atmospheric air. Very small amounts of other gases are present. For example, $CO_2$ from the ambient air would also be present in the oxygen containing gas stream in the low ppm range.

A valveless pulse combustor (VPC) is a preferred embodiment of the combustor to create the ultra-high temperature, oxygen depleted environment for the reduction process. A fuel and an oxygen containing gas stream are mixed and burned in the combustion chamber of the VPC.

An advantage of VPCs is they can operate efficiently at near stoichiometric combustion. This means that the oxygen content in the combustion gas exiting the VPC has a very low oxygen content while still maintaining low CO content. If CO increases appreciably, then the combustion is not efficient. In some embodiments, the oxygen content in the combustion gas is less than 3 vol. % $O_2$. In some embodiments, the oxygen content in the combustion gas is less than 2 vol. % $O_2$. Oxygen content in the combustion gas can be less than 1 vol. %, and even less than 0.5 vol. %. At 2 vol. % $O_2$ in the combustion gas, CO can be <100 ppm. At <1 vol. % $O_2$ in the combustion gas, CO can be less than 300 ppm.

With an incoming oxygen containing gas stream >85 vol. % oxygen, combustion gas temperatures can exceed 2,400° C. At 90 vol. % oxygen, the temperature of the combustion gas exiting the VPC can reach as high as 3,000° C. or more. At 94 vol. % oxygen, the temperature of the combustion gas exiting the VPC can reach as high as 3,300° C. or more.

Non-limiting examples of methods for concentrating oxygen from air to produce oxygen containing gas where the oxygen content is >85 vol. % oxygen include cryogenic gas separation, pressure swing absorption, membrane absorption, vacuum pressure swing absorption, ionic liquid-based absorption, specialized liquid chemical-based absorption, aqueous-salt gas absorption, dry absorption techniques, and/or aqueous-suspended solid gas absorption.

The fuel used by the VPC may be $H_2$ gas. If $H_2$ is burned in the VPC to produce the heat for the reduction process, steam will be the main gas constituent in the combustion gas along with some $N_2$ from the >85 vol. % $O_2$ gas stream needed for high temperature combustion. No $CO_2$ is produced when $H_2$ is burned. The balanced chemical reaction for stoichiometric combustion of $H_2$ is:

$$2H_2+O_2 \rightarrow 2H_2O.$$

The fuel used by the VPC may be a hydrocarbon gas such as natural gas, methane, propane, etc. The fuel used may be a solid hydrocarbon fuel such as lignite coal, brown coal, sub-bituminous coal, bituminous coal, anthracite coal, where the coal is a dry powder with less than 1 wt. % moisture and a particle size less than 150 μm. The fuel used may be a solid hydrocarbon such as solid biowaste from drying forest waste, farm waste, sawdust, wood chip waste, human or animal feces waste, plastic waste, rubber waster, car tire waste, etc. where the solid hydrocarbon fuel is a dry powder with less than 1 wt. % moisture and a particle size less than 150 μm. The fuel used may be a liquid hydrocarbon such as gasoline, diesel, biodiesel, biofuels, waste cooking oils, etc.

Fine particle coal waste, e.g., material from a slurry pond produced from processing coal in a coal prep plant, often has about 25 wt. % to 50 wt. % coal particles by mass. The remaining mass is mineral, most often in the form of aluminosilicates, silica, alumina, iron compounds such as pyrite or iron oxide, calcium oxide, and other minor mineral components. A mineral feedstock comprising metal compound particles (fine particle coal waste) that has a solid hydrocarbon (e.g., fine coal particles) mixed with the mineral particles has advantages as a feedstock for this process. In the ultra-high temperature reaction zone, hydrocarbon particles (e.g., coal particles in fine particle coal waste) undergo pyrolysis to form $H_2$, carbon, and CO, which function as reductants in the disclosed reduction process. The carbon produced by pyrolysis may react with water in the combustion gas to form $H_2$ and CO. The CO may react with water in the combustion gas to form $H_2$ and $CO_2$. $H_2$, CO, and solid carbon particles interact with the minerals to reduce them to elemental metals in the ultra-high temperature reaction zone.

As stated above, metal compound particles for this reduction process may include fine particle coal waste from a coal prep plant. Fine particle coal waste comprises a mixture of solid hydrocarbon particles (e.g., coal) and mineral particles.

Another feedstock of metal compound particles for this reduction process may include coal ash waste from a coal fired power plant. Coal ash waste includes the ash combustion product produced in a coal-fired power plant. Coal ash waste has a high mineral content because the solid coal hydrocarbon was burned. There may still be some char or carbon present in the coal ash waste. The carbon content is usually less than 20% by mass. The coal ash waste may have no carbon or hydrocarbon present due to complete combustion of the coal at the power plant. A feedstock comprising metal compound particles comprising fine particle coal ash that has a solid carbon (e.g., leftover char from coal combustion in a coal fired power plant) mixed with the metal compound particles has advantages as a feedstock for this process. In the ultra-high temperature reaction zone, carbon particles (e.g., char particles in fine particle coal ash) may react with water in the combustion gas to form $H_2$ and CO. The CO may react with water in the combustion gas to form $H_2$ and $CO_2$. $H_2$, CO, and solid carbon particles interact with the metal compound particles to reduce them to elemental metals in the ultra-high temperature reaction zone.

$H_2$ and/or CO and/or carbon are reductants that drive the reduction of the metal compound particles to elemental metals in the ultra-high temperature reaction zone. Coal, which is a solid hydrocarbon, undergoes pyrolysis in the ultra-high temperature reaction zone to supply both $H_2$, CO and/or carbon reductants. If a feedstock of metal compound particles does not have any or enough hydrocarbon blended in with it to supply enough reductants to reduce all the metal compounds present, reductants can be added to the process. Dry fine particle coal waste from a coal prep plant with an ash content less than about 70% by mass likely has enough fine coal particles blended in to supply enough reductants to reduce the mineral.

One method of supplying additional reductants to the process described herein to process a feedstock of metal compound particles is blended solid hydrocarbon particles, such as fine coal particles, with the metal compound particles prior to use in this process. The fine coal particles typically have a size of d90 200 μm. In some embodiments, the fine coal particles have a size of d90 50 μm. In another embodiment, the fine coal particles have a size of d90 10 microns.

Another method of supplying additional reductants to the process described herein to reduce metal compound particles is to blend solid carbon particles with the metal compound particles prior to use in the process. The solid carbon particles may be char particles, coke particles, graphite particles, biochar particles, and/or carbon black, and/or carbon black-like particles called microcarbon particles described in U.S. Pat. No. 11,505,464 B2. The size of the carbon particles may be d90 50 microns. The size of the carbon particles may be d90 10 micron. The size of the carbon particles may be d90 1 micron. The size of the carbon particles may be d90 0.2 micron.

Solid carbon particles or solid hydrocarbon particles that are blended into the coal ash waste or some other source of metal compound particles that does not have enough carbon or solid hydrocarbon to reduce all the metal compound particles present to elemental metals will follow similar reduction reaction pathways with the additives. The carbon reacts with water in the combustion gas to form $H_2$ and CO. The solid hydrocarbon pyrolyzes to from $H_2$ and solid carbon particles. The solid carbon particles react with water in the combustion gas to form $H_2$ and CO. The $H_2$, CO, and solid carbon particles react with the metal compound particles in the ultra-high temperature reaction zone to reduce the metals to elemental form.

Still another method of supplying additional reductants into the process described herein to reduce metal compound particles is to supply a gaseous reductant into the ultra-high temperature reaction zone prior to feeding metal compound particles into the ultra-high temperature reaction zone.

In one embodiment, the gaseous reductant added into the ultra-high temperature reaction zone prior to feeding metal compound particles comprises $H_2$, which can serve directly as a reductant.

In one embodiment, the gaseous reductant added into the ultra-high temperature reaction zone prior to feeding metal compound particles comprises CO, which can serve directly as a reductant.

In another embodiment, the gaseous reductant added into the ultra-high temperature reaction zone prior to feeding metal compound particles comprises a gaseous hydrocarbon such as compressed natural gas (CNG). When CNG is injected into the oxygen depleted and ultra-high temperature gas stream from the combustor, the CNG pyrolyzes to form $H_2$ and solid carbon particles. The carbon may react with water in the combustion gas to form $H_2$ and CO. The $H_2$, CO, and solid carbon particles interact with the metal compound particles to reduce them to elemental metals in the ultra-high temperature reaction zone.

In another embodiment, the gaseous reductant added into the ultra-high temperature reaction zone prior to feeding metal compound particles comprises a blend of $H_2$, CO, and/or gaseous hydrocarbon.

CO can reduce the metal compound particles to form Metal+$CO_2$. $H_2$ can reduce the metal compound particles to produce Metal+$H_2O$. Ideally, there is excess carbon so that whenever $H_2O$ forms when $H_2$ reduces the metal compound particles, the $H_2$ reacts with carbon to form CO+$H_2$ or $CO_2$+$H_2$. Excess $H_2$ reductant and the removal of the $H_2O$ product set up reaction conditions to heavily favor a reaction system where very little to no metal compound is left if the metal compound particles remains in the high temperature reaction zone for long enough time in the presence of the $H_2$, CO, and carbon.

The metal compound particles are reduced in the ultra-high temperature reaction zone. Example reactions that may occur are shown below. These example reactions should not be considered to represent all the reactions that may occur. As used below, the term "MeO" is metal oxide, the term "MeS" is metal sulfide, the term "MeCl" is metal chloride, and the term "MeOH" is metal hydroxide.

$$MeO+H_2 \rightarrow Me+H_2O$$

$$MeO+CO \rightarrow Me+CO_2$$

$$MeS+H_2 \rightarrow Me+H_2S$$

$$MeCl+H_2 \rightarrow Me+HCl$$

$$MeOH+H_2 \rightarrow Me+H_2O$$

In the disclosed process for ultra-high continuous reduction of metal compound particles, individual, fine to very-fine metal individual compound metal particles are reacted with at ultra-high temperature with a reductant. The reduction process proceeds to completion rapidly on an individual particle by individual particle basis during pneumatic conveyance in the ultra-high temperature reactions zone. This is not a bulk process where a bulk material must be melted, penetrated, broken to smaller particles, etc. The fine to very-fine particle sizes have very high surface area. It is known that higher surface area results in faster reactions. The fine to very-fine particle size have a very small diameter and thus a minimized penetration depth for complete reduction of the metal compound particles to elemental metal(s).

In the disclosed process for ultra-high continuous reduction of metal compound particles, carbothermic reaction for reduction of metal compound particles, CO reduction of metal compound particles, and/or hydrogen reduction of metal compound particles occur. Likely all three pathways are occurring at the same time in the ultra-high temperature reaction zone. Multiple reactions pathways may serve to drive to completion the reduction of metal compound particles to element metals.

A general process flow diagram for the reduction process disclosed herein is shown in FIG. 2. An ultra-high temperature, oxygen depleted pneumatic conveyance gas is produced by a combustor where a fuel is burned in the presence of an oxidizer that is >85% $O_2$ (g)<10% $N_2$(g) where $O_2$ is oxygen gas, $N_2$ is nitrogen gas, % is mol % or volume %, and (g) means gas.

In one embodiment, the $O_2$ is about 92%. In another embodiment, $O_2$ is about 94%. In a preferred embodiment, $O_2$ is >99%.

An embodiment of the combustor is a pulse jet combustor. A preferred embodiment is a valveless pulse combustor.

An embodiment of the fuel is gaseous fuel. An embodiment of a gaseous fuel is a hydrocarbon gas. Another embodiment of a gaseous fuel is hydrogen gas. A preferred embodiment of a gaseous hydrocarbon fuel is compressed natural gas. Another preferred embodiment of a gaseous hydrocarbon fuel is propane gas. Other embodiments of the fuel include solid hydrocarbons and liquid hydrocarbons.

In one embodiment, combustion of a fuel in the presence of >85% $O_2$ results in an ultra-high temperature combustion gas that is >2,700° C. In another embodiment, combustion of a fuel the presence of >90% $O_2$ results in an ultra-high temperature combustion gas that is >3,000° C.

The use of a pulse combustor produces a low oxygen content or oxygen deprived combustion gas. In one embodiment, the $O_2$ content of the combustion gas is <3 vol. %. In another embodiment, the $O_2$ content of the combustion gas is <2 vol. %. In a further embodiment, the $O_2$ content of the combustion gas is <1 vol. %. In another embodiment, the $O_2$ content of the combustion gas is <0.5 vol. %

In one embodiment, a gaseous reductant may be introduced into the ultra-high temperature reaction zone before the metal compound particles. The gaseous reductant may be hydrogen which can serve directly as a reductant. The gaseous reductant may be carbon monoxide (CO) which can serve directly as a reductant. The gaseous reductant may be a gaseous hydrocarbon such as natural gas, which would undergo pyrolysis to form hydrogen and carbon, both of which may serve as reductants.

In one embodiment, a liquid reductant may be introduced into the ultra-high temperature zone before the metal compound particles. The liquid reductant may be a liquid hydrocarbon such as diesel, biodiesel, ethanol, bioethanol, biofuels, gasoline, pentane, hexane, etc. which would undergo pyrolysis to form hydrogen and carbon, both of which may serve as reductants.

Metal compound particles are introduced into the ultra-high temperature reaction zone. One method of introducing the metal compound particles is with an auger feeder. Another method is dense-phase pneumatic conveyance. The feed rate of the metal compound particles is adjusted to maintain a target temperature at the exit of the ultra-high temperature reaction zone.

In one embodiment, the temperature at the exit of the ultra-high temperature reaction zone is about 1,850° C.

In one embodiment, the temperature at the exit of the ultra-high temperature reaction zone is >1,850° C.

In one embodiment, the temperature at the exit of the ultra-high temperature reaction zone is >2,000° C.

In one embodiment, the temperature at the exit of the ultra-high temperature reaction zone is >2,500° C.

In one embodiment, the temperature at the exit of the ultra-high temperature reaction zone is >2,800° C.

In one embodiment, the temperature at the exit of the ultra-high temperature reaction zone is >3,000° C.

FIG. 2 shows one possible embodiment of this process where specific temperatures are targeted after the ultra-high temperature reaction zone. In this example embodiment, the metal compound particles are added to the reaction zone at a rate that results in a temperature of 1,850° C. at the exit of the ultra-high temperature reaction zone. After the ultra-high temperature reaction zone, there is a gas-vapor/liquid-solid separator that equilibrates to about the 1,850° C. temperature exiting the ultra-high temperature reaction zone. In other words, the gas-vapor/liquid-solid separator operating temperature equilibrates to the temperature of the incoming gases, vapors, liquids, and/or entrained solid particles exiting the reaction zone.

One example of a gas-vapor/liquid-solid separator is a cyclone. Another example of a gas-vapor/liquid-solid separator is an electrostatic precipitator. Solids and liquids that are entrained in the gas stream that can be removed from the gas stream by the gas-vapor/liquid-solid separator exit the bottom of the gas-vapor/liquid-solid separator. Usually, the solid particles or liquid droplets need to have a size greater than about 10 microns to be collected from the bottom of a cyclone gas-vapor/solid-liquid separator. The solids and liquids collected from the bottom of a gas-vapor/liquid-solid separator enter into a cooled collection location. The gas stream continues to downstream equipment along with any vapors, liquids, and/or solids that may be present.

After the first gas-vapor/liquid-solid separator, a cooling mechanism may be used to reduce the temperature of the gas stream and any entrained vapor, liquids, and/or solids to a lower temperature. In one embodiment, a cooling mechanism may be a heat exchanger. In another embodiment, a cooling mechanism may be the injection of enough steam to cool the gas stream and entrained vapors, liquids, and/or solids to the target temperature. In another embodiment, a cooling mechanism may be the injection of enough atomized water to cool the gas stream and entrained vapors, liquids, and/or solids to the target temperature. In another embodiment, a cooling mechanism may be the injection of enough liquid nitrogen to cool the gas stream and entrained vapors, liquids, and/or solids to the target temperature. One of the embodiments of a cooling mechanism may be used. A combination of the embodiments of a cooling mechanism may be used together. In the example embodiment shown in FIG. 2, the first cooling mechanism reduces the gas stream and entrained vapors, liquids, and/or solids from about 1,850° C. to about 1,000° C.

The 1,000° C. gas stream and entrained vapors, liquids, and/or solids enter into a second gas-vapor/liquid-solid separator. Any liquids and solids deposit or condense during the cooling step and that meet the separation criteria of the gas-vapor/liquid-solid separate exit the bottom of as was described for the first gas-vapor/liquid-solid separator to a cooled collection location.

A second cooling mechanism may be used after the second gas-vapor/liquid-solid separator, to reduce the temperature of the gas stream and any entrained vapor, liquids, and/or solids to a lower temperature. In one embodiment, a cooling mechanism may be a heat exchanger.

In another embodiment, a cooling mechanism may be the injection of enough steam to cool the gas stream and entrained vapors, liquids, and/or solids to the target temperature. In another embodiment, a cooling mechanism may be the injection of enough atomized water to cool the gas stream and entrained vapors, liquids, and/or solids to the target temperature. In another embodiment, a cooling mechanism may be the injection of enough liquid nitrogen to cool the gas stream and entrained vapors, liquids, and/or solids to the target temperature. One of the embodiments of a cooling mechanism may be used. A combination of the embodiments of a cooling mechanism may be used together. In the example embodiment shown in FIG. 2, the second cooling mechanism reduces the gas stream and entrained vapors, liquids, and/or solids from about 1,000° C. to about 500° C.

The 500° C. gas stream and entrained vapors, liquids, and/or solids enter into a second gas-vapor/liquid-solid separator. Any liquids and solids deposit or condense during the cooling step and those that meet the separation criteria of the gas-vapor/liquid-solid separator exit the bottom as was described for the first gas-vapor/liquid-solid separator to a cooled collection location.

A third cooling mechanism may be used after the third gas-vapor/solid-liquid separator, to reduce the temperature of the gas stream and any entrained vapor, liquids, and/or solids to a lower temperature. In one embodiment, a cooling mechanism may be a heat exchanger. In another embodiment, a cooling mechanism may be the injection of enough steam to cool the gas stream and entrained vapors, liquids, and/or solids to the target temperature. In another embodiment, a cooling mechanism may be the injection of enough atomized water to cool the gas stream and entrained vapors, liquids, and/or solids to the target temperature. In another embodiment, a cooling mechanism may be the injection of enough liquid nitrogen to cool the gas stream and entrained vapors, liquids, and/or solids to the target temperature. One of the embodiments of a cooling mechanism may be used. A combination of the embodiments of a cooling mechanism may be used together. In the example embodiment shown in FIG. 2, the third cooling mechanism reduces the gas stream and entrained vapors, liquids, and/or solids from about 500° C. to <200° C.

The <200° C. gas stream and entrained vapors, liquids, and/or solids enter into a baghouse gas-vapor/liquid-solid separator. Any liquids and solids that are deposited or condensed during the third cooling step are filtered out of the gas stream in the baghouse and exit the bottom of the baghouse to a cooled collection location.

The gas stream may exit the facility directly through an exhaust stack or it may be further processed by vapor and gas separation techniques. Non-limiting examples of gas separation techniques include cryogenic gas separation, pressure swing absorption, membrane absorption, vacuum pressure swing absorption, ionic liquid-based absorption, specialized liquid chemical-based absorption, aqueous-salt gas absorption, dry absorption techniques, and/or aqueous-suspended solid gas absorption.

Figure 3:
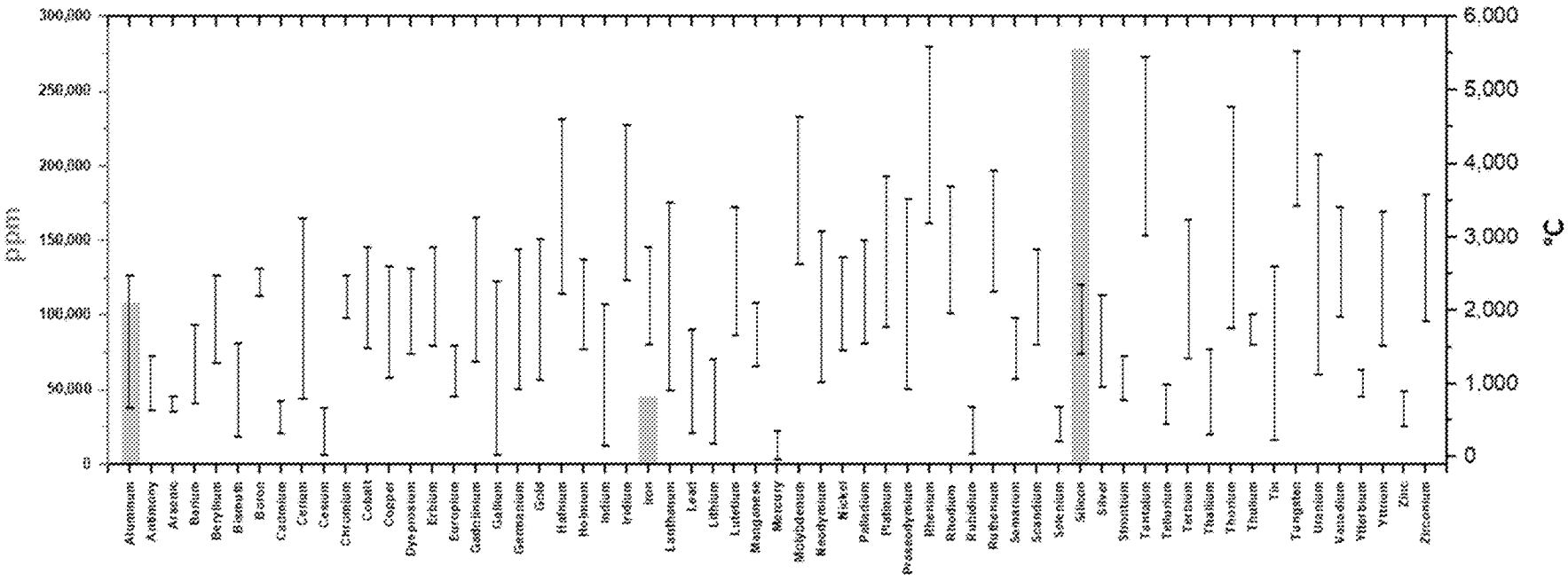
FIG. 3 shows the concentration of target metals as detected by inductive coupled plasma atomic emission spectroscopy (ICP-AES) characterization for a sample of fine particle coal waste from a coal prep plant with a flotation circuit to further clean up the tailings or fine particle coal waste. The melting and boiling points of the metals are also shown by horizontal dashes with a vertical line connecting them.

FIG. 3 shows the concentration of target metals as detected by inductive coupled plasma atomic emission spectroscopy (ICP-AES) characterization for a sample of fine particle coal waste from a coal prep plant with a flotation circuit to further clean up the tailings or fine particle coal waste. This fine particle coal waste had a particle size of d99 200 microns with an d50 of 7 microns. The ash content was about 80%. The sample was digested completely in strong acid. The ions in solution were then quantified with ICP-AES. These metal elements are mostly present in mineral form as an oxide, aluminosilicate (clay), clay bound ion, salt, or another mineral compound rather than the pure, elemental metal. The concentration of the listed valuable metals in the fine particle coal waste sample is shown by the blue bar and corresponds to the ppm value in the left y-axis. Aluminum, iron, and silicon were present in such high concentrations, the concentration of the rest of the metals cannot be seen in FIG. 3. The melting and boiling points of the metals are also shown by horizontal dashes with a vertical line connecting the dashes and correspond to the right y-axis.

The data in FIG. 3 is shown by way of example to indicate that multiple metals are present in the mineral component of fine particle coal waste produced by a coal preparation plant. It should be understood that the metals present and the concentrations of the metals present in FIG. 3 (as well as FIG. 4, FIG. 5, and FIG. 6) are given by way of example only and is not intended to represent the concentration of any other sample of fine particle coal waste or fine particle coal ash that might be characterized from somewhere else at this same impoundment or another impoundment. The metals present and the concentrations of the metals that are present in a given sample may vary within the fine particle coal waste at an impoundment because the fine particle coal waste in the impoundment represents years of mining different locations and seams. Similarly, the metals present and the concentrations of the metals present may vary from one impoundment to another impoundment because the sites are produced from different mines or different mine depths.

It should also be understood that the metals present and concentrations of metals present may vary within a fine particle coal ash impoundment and from one coal ash impoundment to another coal ash impoundment because coals from different mines may have been burned at different times during the accumulation of the fine particle waste at the at a given coal ash impoundment and because coal from different mines may have been burned to produce the different coal ash impoundments.

Figure 4:
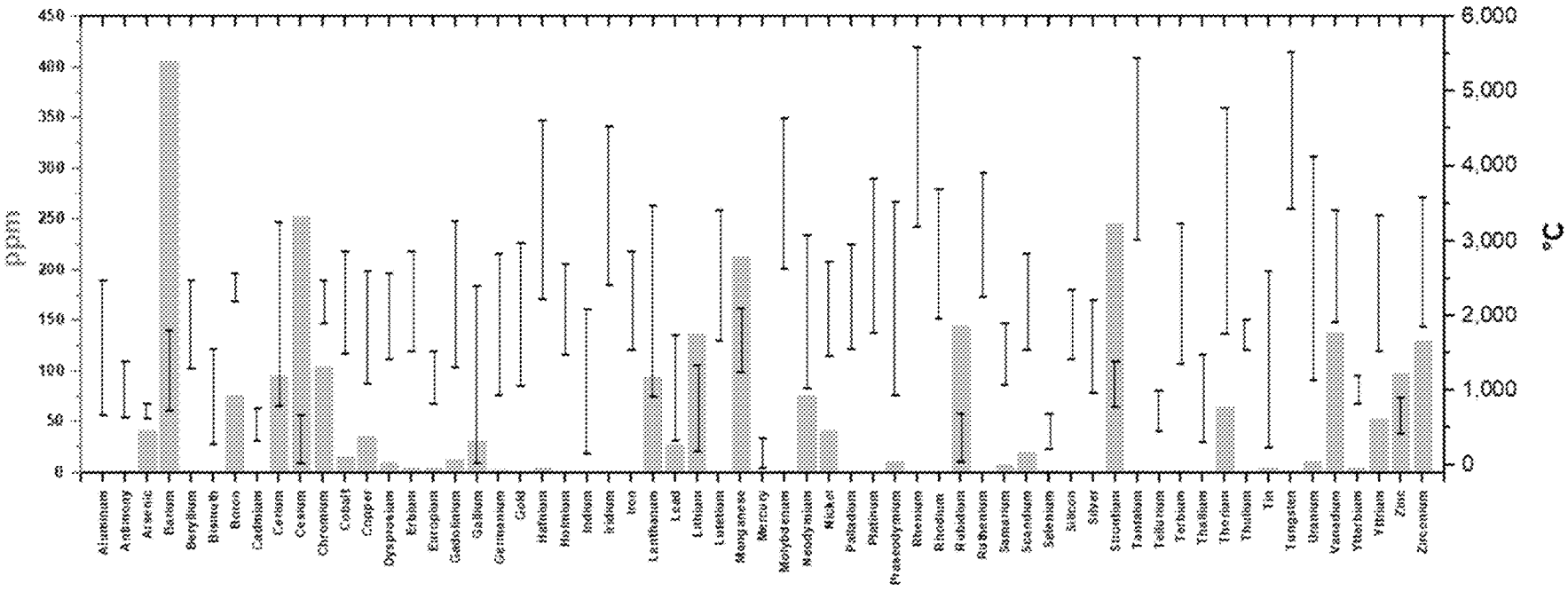
FIG. 4 shows the concentration of target metals as detected by ICP-AES characterization for a sample of fine particle coal waste from a coal prep plant with a flotation circuit to further clean up the tailings or fine particle coal waste. The melting and boiling points of the metals are also shown by horizontal dashes with a vertical line connecting them. Compared to FIG. 3, the concentration of aluminum, iron, and silicon have been removed from the data set to show the concentration of the other metals that are present.

FIG. 4 shows the concentration of target metals as detected by ICP-AES characterization for a sample of fine particle coal waste from a coal prep plant with a flotation circuit to further clean up the tailings or fine particle coal waste. The melting and boiling points of the metals are also shown by horizontal dashes with a vertical line connecting them. Compared to FIG. 3, the concentration of aluminum, iron, and silicon have been removed from the data set to show the concentration of the other metals that are present. The maximum ppm value on the left y-axis is 450 ppm. It becomes clear that other metal elements are present in the fine particle waste sample (metal compound particles), but at much lower concentrations.

Figure 5:
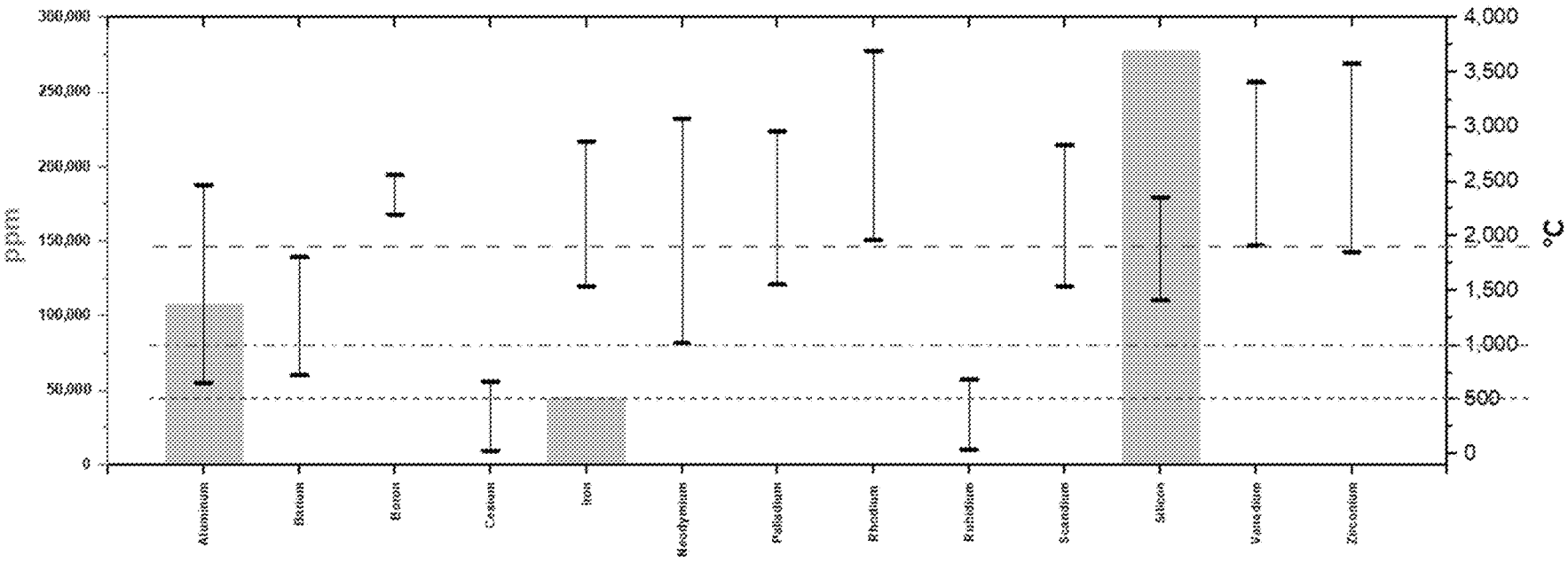
FIG. 5 shows the concentration of a selected set of metals as detected by ICP-AES characterization from the data sets shown in FIG. 3 and FIG. 4. The melting and boiling points of the metals are also shown by horizontal dashes with a vertical line connecting them.
Figure 6:
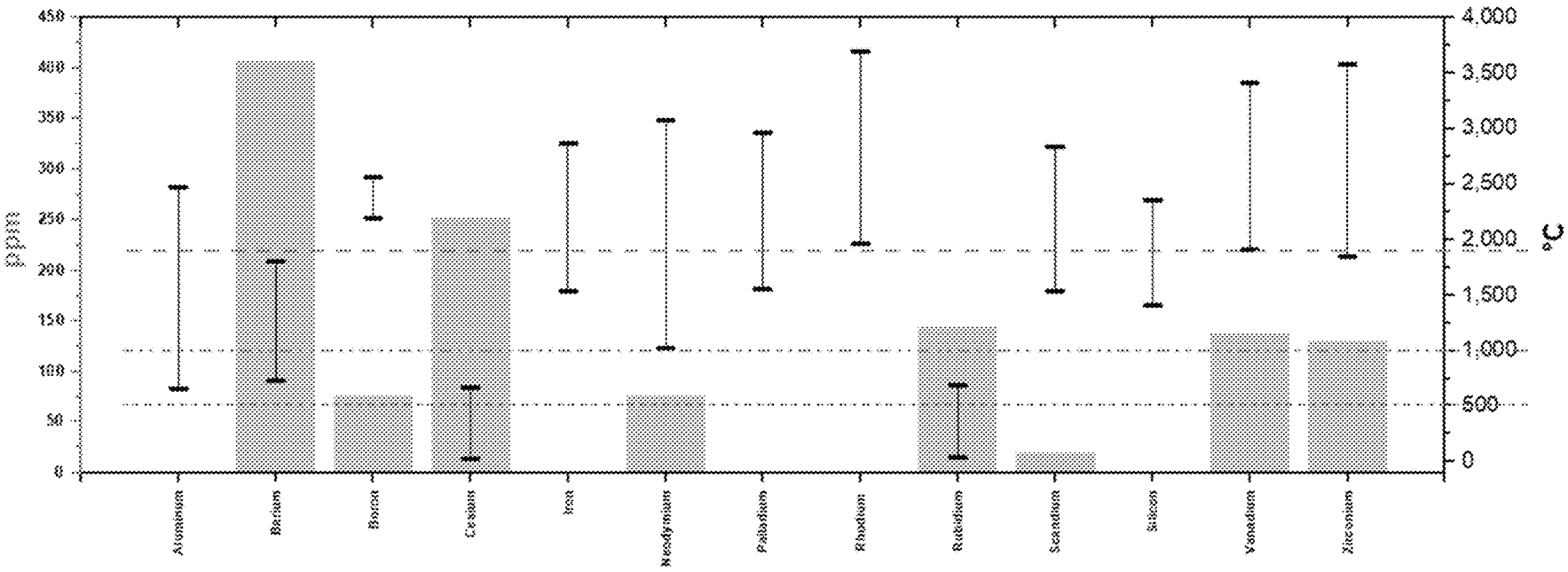
FIG. 6 shows the concentration of a selected set of metals as detected by ICP-AES characterization from the data sets shown in FIG. 3 and FIG. 4. The melting and boiling points of the metals are also shown by horizontal dashes with a vertical line connecting them. Compared to FIG. 5, the concentration of aluminum, iron, and silicon have been removed from the data set to show the concentration of the other metals that are present.

FIG. 5 and FIG. 6 show the concentration of a selected set of metals as detected by ICP-AES characterization from the data sets shown in FIG. 3 and FIG. 4. The melting and boiling points of the metals are also shown by horizontal dashes with a with a vertical line connecting the dashes. In FIG. 6, the concentration of aluminum, iron, and silicon have been removed from the data set to show the concentration of the other metals that are present. Dashed lines are also added to FIG. 5 and FIG. 6 to represent the temperatures of the first gas-vapor/liquid-solid separator, the second gas-vapor/liquid-solid separator, and the third gas-vapor/liquid-solid separator in FIG. 2. A gas-vapor/liquid-solid separator equilibrates to about the temperature of the incoming gas stream.

Referring back to FIG. 2 as an embodiment of the disclosed reduction process and using the metals shown in FIG. 5 and FIG. 6 as example metals that comprise the metal compound particles, the metal compound particles are added through the feeder at a rate such that the temperature at the exit of the ultra-high temperature reaction zone is about 1,850° C. FIGS. 5 and 6 have a long-dashed line representing a temperature of 1,850° C. The boiling point of barium, cesium, and rubidium fall below 1,850° C. These three metals will be present in the vapor phase at 1,850° C. The melting points of boron, rhodium, vanadium, and potentially zirconium are all above 1,850° C. These metals would exist in a solid phase at 1,850° C. The remaining metals would be in the liquid phase.

The gas stream containing solid, liquid, and vapor metals exits the high temperature reaction zone and enters a first gas-vapor/liquid-solid separator which equilibrates to about 1,850° C. A non-limiting example of such a device is a cyclone separator. The liquid metals and solid metals are removed from the gas stream and exit the bottom of the cyclone separator. Cyclones can be designed with different target sizes that exit the bottom of the cyclone. A common size is about 10 microns, although smaller sizes such as 2-3 microns are possible. Solid elemental particles and elemental metal droplets larger than the cutoff size exit the bottom of the cyclone to the cooled collection location which would include aluminum, boron, iron, neodymium, palladium, rhodium, scandium, silicon, vanadium, and zirconium if they are present in the metal compound particles. Unreacted carbon and mineral particles that are larger than the cutoff size would also exit the bottom of this first gas-vapor/liquid-solid separator. Solids and liquids that are smaller than the cutoff size would exit the top of the gas-vapor/liquid-solid separator. The vapor metals exit out the top of the cyclone separator with the hot gas stream which would include boron, cesium, and rubidium if they are present in the metal compound particles. In this example where the metals in FIG. 5 and FIG. 6 are used as example metals that comprise the metal compound particles, all elemental metals present in the metal compound particles added to the ultra-high temperature reaction zone which are reduced to elemental metals in the ultra-high temperature reaction zone would exit the bottom of the cyclone separator except for barium, cesium, and rubidium, which would be in the vapor phase. The material that exits the bottom of the cyclone separators could be cooled in bulk to make a blended metal ingot. Further separation could be carried out based on melting temperature and density if alloys between the elemental metals present do not form.

The hot gas stream with barium, cesium, and rubidium continues through the system. Cooling of the hot gas stream via a cooling mechanism lowers the temperature of the hot gas stream to below the boiling point of barium, such as 1000° C. as indicated by the dash-dot-dot line in FIG. 5 and FIG. 6. Barium is now in the liquid phase. The gas stream passes through a second gas-vapor/liquid-solid separator. The liquid barium exits the bottom of the separator. It can be cooled to form a barium ingot. The vapor metals exit out the top of the cyclone separator with the hot gas stream. In this example, cesium and rubidium exit the top of the cyclone in the vapor phase with the hot gas stream. Solids and liquids that are smaller than the cutoff size would exit the top of the gas-vapor/liquid-solid separator.

The hot gas stream with cesium and rubidium continues through the system. Cooling of the hot gas stream via a cooling mechanism lowers its temperature below the boiling point of cesium and rubidium, such as 500° C. as indicated by the short-dash line. Cesium and rubidium are now in the liquid phase. The gas stream passes through a third gas-vapor/liquid-solid separator. The liquid cesium and rubidium exit the bottom of the separator.

The liquid cesium and rubidium that exit the bottom of the gas-vapor/liquid-solid separator could be cooled to make a blended metal ingot. Optionally further separation may be carried out based on melting temperature and density if alloys between the metals do not form. The melting temperature of rubidium is 40° C. and of cesium is 29° C. The material could be cooled to 30° C. Rubidium would be a solid, while cesium would remain a liquid. The two metals could be separated because they are different phases.

The hot gas stream should be free of entrained metal compound particles at this point, although it is possible there may be some unreacted metal compound particles depending on the amount and nature of reductants present to allow for the needed reduction pathway of the metal compound particles to elemental metals. The process gas stream may then be sent to downstream processing equipment which may include another cooling mechanism to below 200° C. to allow the process gas and any remaining vapors, liquids, and/or solids to go to a baghouse to separate solid particles that may remain in the gas stream. A solid that may be present is very fine particles of carbon which may be carbon black-like in nature. Very fine char may be present. Very fine graphitic particles may be present.

After final solids removal in the baghouse, the process gas may be processed further to separate the gases and vapors that may be present. Examples of gases that may be present which may have value are $H_2$, $CO_2$, $NH_3$, $H_2S$, $NO_x$, $SO_x$ and water. Cooling the gas further can condense the water vapor that may be in the gas stream. Methods such as pressure swing absorption and/or cryogenic gas capture and separation may be used to separate gases that may be present. The unreacted $H_2$ that is collected can be used as fuel for the process. Another option is to inject the $H_2$ as a reductant in the process. The $H_2$ could also be sold into the marketplace.

This example is given for illustrative purposes only and should not be seen as limiting. Depending on the metals present and the combination of melting points and boiling points of those metals, more or fewer gas-vapor/liquid-solid separator steps could be employed in a process at different temperatures to satisfy targeted separation goals.

It may be advantageous to operate the reduction process with a higher temperature in the ultra-high temperature reaction zone than the temperature of about 1,850° C. in the example embodiment shown in FIG. 2. An advantage for operating at a higher temperature than 1,850° C. would be to drive the reduction of the metal compound particles feedstock to elemental metals to completion. An advantage for operating at a higher temperature than 1,850° C. would be to keep target element metal(s) in their vapor state. An advantage for operating at a higher temperature than 1,850° C. would be to keep target element metal(s) in their liquid state.

In one embodiment, the feed rate of the mineral-containing feedstock is controlled so the exit temperature of the ultra-high temperature reaction zone is about 2,000° C. In one embodiment, the feed rate of the mineral-containing feedstock is controlled so the exit temperature of the ultra-high temperature reaction zone is about 2,500° C. In one embodiment, the feed rate of the mineral-containing feedstock is controlled so the exit temperature of the ultra-high temperature reaction zone is about 3,000° C.

In one embodiment, the feed rate of the mineral-containing feedstock is controlled so the exit temperature of the ultra-high temperature reaction zone is >2,000° C. In one embodiment, the feed rate of the mineral-containing feedstock is controlled so the exit temperature of the ultra-high temperature reaction zone is >2,500° C. In one embodiment, the feed rate of the mineral-containing feedstock is controlled so the exit temperature of the ultra-high temperature reaction zone is >3,000° C.

It may be advantageous to rapidly reduce the temperature after the ultra-high temperature reaction zone. At lower temperatures than those in the ultra-high temperature reaction zone, reverse reactions or side reactions with gases, liquids, and solids present in the gas stream to species other than the elemental metals may occur or even be favored. One advantage of rapidly reducing the temperature after the ultra-high temperature reaction zone would be to bypass temperatures where reverse reactions and side reactions may occur.

Figure 7:
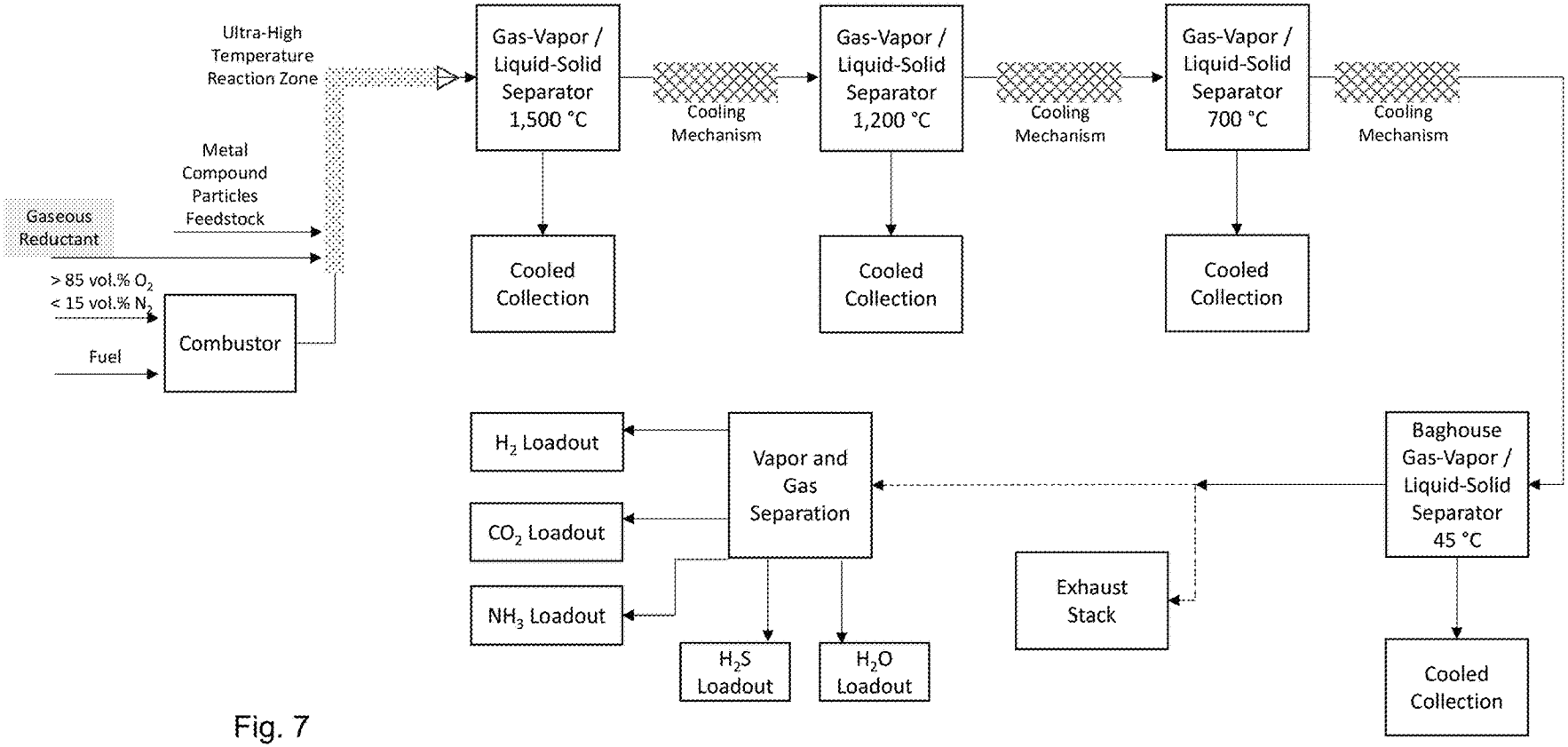
FIG. 7 shows an all-inclusive flow chart showing various non-limiting iterations, combinations, and variations of the disclosed invention. The open triangle at the end of the ultra-high temperature reaction zone represents a nozzle that causes adiabatic cooling.

FIG. 7 is an all-inclusive flow chart showing various non-limiting iterations, combinations, and variations of the disclosed invention that is a variation of FIG. 2. The open triangle at the end of the ultra-high temperature reaction zone represents a nozzle that causes adiabatic cooling. As described in preceding paragraphs, embodiments of the process have feed rates such that the temperature at the exit of the ultra-high temperature reaction zone is much greater than 1,850° C., even greater than 3,000° C. In such cases, a cooling mechanism may be needed before the first gas-vapor/liquid-solid separator to produce the first temperature of the first gas-vapor/liquid-solid separator. If cooling is needed between the ultra-high temperature zone and the first gas-vapor/liquid-solid separator, adiabatic cooling is a preferred embodiment.

If the embodiment of the process shown in FIG. 7 were operated with a feed rate such that the exit temperature of the ultra-high temperature reaction zone was 3,000° C. going into the adiabatic cooling nozzle, a pressure of about 215 pounds per square inch would be needed upstream of the nozzle to drive nearly instantaneous temperature reduction after the nozzle via adiabatic cooling in order to enter the first gas-vapor/liquid-solid separator at about 1,500° C.

The example embodiment in FIG. 7 shows a temperature of 1,200° C. for the second gas-vapor/liquid-solid separator, a temperature of 700° C. for the third gas-vapor/liquid-solid separator, and a temperature of 45° C. for the baghouse gas-vapor/liquid-solid separator. These temperatures for the gas-vapor/liquid-solid separators in FIG. 2 and in FIG. 7 are not intended to represent exact operation temperatures that must be used. Different temperatures were shown in FIG. 7 to illustrate that a process could be designed for various temperature targets. The process would be designed based on the boiling/condensing and melting/freezing point(s) of the elemental metals produced from a target metal compound particles feedstock. The ability to select a temperature based on material properties of elemental metals in the gas stream is important to allow for the separation of elemental metals present in the gas stream based on their material properties. Such separation would result in the concentration of elemental metals into different collection locations based on their material properties.

The embodiments in FIG. 2 and in FIG. 7 both show three gas-vapor/liquid-solid separators before a baghouse gas-vapor/liquid-solid separator. More or fewer gas-vapor/liquid-solid separator may be used based on the material properties of the elemental metals in the gas stream and the number of collection and concentration separation events that are desired in the process.

EMBODIMENTS

Various embodiments are listed below. It will be understood that the embodiments listed below may be combined with all aspects and other embodiments in accordance with the scope of the invention.

Embodiment 1. A continuous process for converting metal compound particles into a mixture of elemental metals comprising: introducing the metal compound particles and a reductant into an ultra-high temperature reaction zone, wherein the metal compound particles have particle sizes of d90 500 μm, and wherein the ultra-high temperature reaction zone has a temperature greater than 2,700° C. and an oxygen content less than 3 vol. %, wherein the metal compound particles have a residence time less than 1 minute in the ultra-high temperature reaction zone sufficient to mix with and react with the reductant to reduce the metal compound particles to form a mixture of elemental metals; removing gases, vapors, liquids, and/or entrained solid particles comprising the mixture of elemental metals from the ultra-high temperature reaction zone; and separating the mixture of elemental metals from gases, vapors, liquids, and/or entrained solid particles and concentrating one or more elemental metals from the mixture of elemental metals within one or more separation zones based on differential size and density of the one or more elemental metals and the remaining mixture of elemental metals.

Embodiment 2. The process according to Embodiment 1, wherein the metal compound particles have a d90 particle size less than 200 μm.

Embodiment 3. The process according to Embodiment 1, wherein the metal compound particles have a d90 particle size less than 100 μm.

Embodiment 4. The process according to Embodiment 1, wherein the metal compound particles have a d90 particle size less than 50 μm.

Embodiment 5. The process according to any preceding Embodiment, wherein the metal compound particles comprise one or more rare earth metals.

Embodiment 6. The process according to any of Embodiments 1 through 4, wherein the metal compound particles comprise one or more transition metals.

Embodiment 7. The process according to any preceding Embodiment, wherein the ultra-high temperature reaction zone has an oxygen content less than 1 vol. %.

Embodiment 8. The process according to any preceding Embodiment, wherein combustion gas exiting a pulse combustor is introduced into the ultra-high temperature reaction zone.

Embodiment 9. The process according to any preceding Embodiment, wherein the reductant comprises carbon particles.

Embodiment 10. The process according to Embodiment 9, wherein the carbon particles have a particle size of d90 10 μm.

Embodiment 11. The process according to Embodiment 9, wherein the carbon particles have a particle size of d90 5 μm.

Embodiment 12. The process according to Embodiment 9, wherein the carbon particles have a particle size of d90 1 μm.

Embodiment 13. The process according to Embodiment 9, wherein the carbon particles have a particle size of d50 100 nm.

Embodiment 14. The process according to any of Embodiments 1 through 8, wherein the reductant comprises hydrogen gas.

Embodiment 15. The process according to any of Embodiments 1 through 8, wherein the reductant comprises carbon monoxide gas.

Embodiment 16. The process according to any of Embodiments 1 through 8, wherein the reductant comprises a hydrocarbon.

Embodiment 17. The process according to Embodiment 16, wherein the hydrocarbon comprises coal.

Embodiment 18. The process according to Embodiment 16, wherein the hydrocarbon comprises natural gas.

Embodiment 19. The process according to any of Embodiments 1 through 8, wherein the reductant comprises at least two reductants selected from hydrogen gas, carbon monoxide gas, or natural gas.

Embodiment 20. The process according to any preceding Embodiment, wherein the metal compound particles comprise fine particle coal waste from a mine or a mining process.

Embodiment 21. The process according to any of Embodiments 1 through 19, wherein the metal compound particles comprise coal ash waste.

Embodiment 22. The process according to any preceding Embodiment, wherein the metal compound particles have a residence time less than 50 seconds, 40 seconds, 30 seconds, 25 seconds, 20 seconds, 18 seconds, 16 seconds, 14 seconds, 12 seconds, 10 seconds, 9 seconds, 8 seconds, 7 seconds, 6 seconds, 5 seconds, 4 seconds, 3 seconds, 2 seconds, or 1 second in the ultra-high temperature reaction zone.

Embodiment 23. A process for separating one or more elemental metals from a mixture of elemental metals produced via ultra-high temperature reduction of metal compound particles, wherein the mixture of elemental metals have a temperature greater than 1850° C., comprising disposing the mixture of elemental metals within a first cyclone operating at a first cyclone temperature to separate one or more elemental metals from a remaining mixture of elemental metals based on a differential size and/or density of the one or more elemental metals and the remaining mixture of elemental metals.

Embodiment 24. The process according to Embodiment 23, comprising disposing the remaining mixture of elemental metals within a second cyclone operating at a second cyclone temperature to separate one or more further elemental metals from a further remaining mixture of elemental metals based on a differential size and/or density of the one or more further elemental metals and the further remaining mixture of elemental metals.

Embodiment 25. The process according to Embodiment 24, comprising disposing the further remaining mixture of elemental metals within one or more subsequent cyclones connected in series and operating at different cyclone temperatures to separate one or more subsequent elemental metals from a subsequent remaining mixture of elemental metals based on a differential size and/or density of the one or more subsequent elemental metals and the subsequent remaining mixture of elemental metals.

Embodiment 26. The process according to Embodiment 24, wherein a temperature reduction of the remaining mixture of elemental metals occurs between the first cyclone and the second cyclone.

Embodiment 27. The process according to Embodiment 24, wherein the temperature reduction is accomplished with a heat exchanger.

Embodiment 28. The process according to Embodiment 24, wherein the temperature reduction is accomplished by introducing a spray of liquid nitrogen.

Embodiment 29. The process according to Embodiment 24, wherein the temperature reduction is accomplished by introducing a spray of water.

Embodiment 30. The process according to Embodiment 23, wherein the first cyclone temperature equilibrates to the temperature of the incoming mixture of elemental metals.

Embodiment 31. The process according to Embodiment 23, wherein a nozzle is disposed between the ultra-high temperature reaction zone and the first cyclone operating at a first cyclone temperature.

Embodiment 32. A continuous process for converting metal compound particles into a mixture of elemental metals comprising: burning a fuel in a combustor with >85% $O_2$ to create an ultra-high temperature process gas which provides heat and temperature for an ultra-high temperature reaction zone, and wherein the ultra-high temperature reaction zone has an initial temperature greater than 2,700° C. and an oxygen content less than 3 vol. % after combustion; introducing metal compound particles into the ultra-high temperature process gas at an entrance of the ultra-high temperature reaction zone where the metal compound particles are transported through the ultra-high temperature reaction zone to downstream equipment via pneumatic conveyance, wherein the metal compound particles have particle sizes of d90 500 μm, wherein the metal compound particles have a residence time less than 1 minute in the ultra-high temperature reaction zone sufficient to mix with and react with a reductant in the ultra-high temperature reaction zone to reduce the metal compound particles to a mixture of elemental metals; causing the process gas to exit the ultra-high temperature reaction zone at a temperature greater than 1,850° C., where the process gas temperature exiting the ultra-high temperature reaction zone is controlled by the rate of addition of dry (<0.5% moisture by mass) metal compound particles to the ultra-high temperature reaction zone, and wherein the process gas exits the ultra-high temperature reaction zone with the products from the continuous ultra-high temperature reduction of metal compound particles in pneumatic conveyance and wherein said products comprise a mixture of elemental metals consisting of gases, vapors, liquids, and/or entrained solid particles; and separating the mixture of elemental metals from process gases, vapors, liquids, and/or entrained solid particles and concentrating one or more elemental metals from the mixture of elemental metals within one or more gas-vapor/liquid-solid separators based on differential size and density of solid particles and/or liquid droplets that exist at the temperature of the process gas and materials in pneumatic conveyance as they pass through the one or more gas-vapor/liquid-solid separators, where the solids and/or liquid droplets that are separated from the process gas stream in the gas-vapor/liquid-solid separator exit the bottom to a cooled collection location and the process gas continues downstream with a new composition of elemental metals because of the separation step to downstream equipment that may comprise one or more gas-vapor/liquid-solid separators at lower temperatures to further separate solid particles and/or liquid droplets in each subsequent gas-vapor/liquid-solid separators based on differential size and density of solid particles and/or liquid droplets that exist at the temperature of the process gas and materials in pneumatic conveyance as they pass through the sequential gas-vapor/liquid-solid separators, and where the final separation step may be a baghouse gas-vapor/liquid-solid separators at less than 200° C.

Embodiment 33. The process according to Embodiment 32, wherein the reductant is formed by pyrolysis of hydrocarbon particles such as coal mixed with the metal compound particles.

Embodiment 34. The process according to Embodiment 32 where the reductant is gaseous and to the ultra-high temperature reaction zone before the dry (<0.5% moisture by mass) metal compound particles are added to the ultra-high temperature reaction zone.

Embodiment 35. The process according to Embodiment 34 where the reductant is $H_2$ gas.

Embodiment 36. The process according to Embodiment 34 where the reductant is CO gas.

Embodiment 37. The process according to Embodiment 34 where the reductant is natural gas.

The described embodiments and examples are all to be considered in every respect as illustrative only, and not as being restrictive. The scope of the invention is, therefore, indicated by the appended claims, rather than by the foregoing description. All changes that come within the meaning and range of equivalency of the claims are to be embraced within their scope.

The invention claimed is:

1. A continuous process for converting metal compound particles into a mixture of elemental metals comprising:

introducing the metal compound particles and a reductant into an ultra-high temperature reaction zone, wherein the metal compound particles have particle sizes of d90 500 μm, and wherein the ultra-high temperature reaction zone has a temperature greater than 2,700° C. and an oxygen content less than 3 vol. %, wherein the metal compound particles have a residence time less than 1 minute in the ultra-high temperature reaction zone sufficient to mix with and react with the reductant to reduce the metal compound particles to form a mixture of elemental metals;

removing gases, vapors, liquids, and/or entrained solid particles comprising the mixture of elemental metals from the ultra-high temperature reaction zone; and separating the mixture of elemental metals from gases, vapors, liquids, and/or entrained solid particles and concentrating one or more elemental metals from the mixture of elemental metals within one or more separation zones based on differential size and density of the one or more elemental metals and the remaining mixture of elemental metals.

2. The process according to claim 1, wherein the metal compound particles have a d90 particle size less than 200 μm.

3. The process according to claim 1, wherein the metal compound particles have a d90 particle size less than 100 μm.

4. The process according to claim 1, wherein the metal compound particles have a d90 particle size less than 50 μm.

5. The process according to claim 1, wherein the metal compound particles comprise one or more rare earth metals.

6. The process according to claim 1, wherein the metal compound particles comprise one or more transition metals.

7. The process according to claim 1, wherein the ultra-high temperature reaction zone has an oxygen content less than 1 vol. %.

8. The process according to claim 1, wherein combustion gas exiting a pulse combustor is introduced into the ultra-high temperature reaction zone.

9. The process according to claim 1, wherein the reductant comprises carbon particles.

10. The process according to claim 9, wherein the carbon particles have a particle size of d90 10 μm.

11. The process according to claim 9, wherein the carbon particles have a particle size of d90 5 μm.

12. The process according to claim 9, wherein the carbon particles have a particle size of d90 1 μm.

13. The process according to claim 9, wherein the carbon particles have a particle size of d50 100 nm.

14. The process according to claim 1, wherein the reductant comprises hydrogen gas.

15. The process according to claim 1, wherein the reductant comprises carbon monoxide gas.

16. The process according to claim 1, wherein the reductant comprises a hydrocarbon.

17. The process according to claim 16, wherein the hydrocarbon comprises coal.

18. The process according to claim 16, wherein the hydrocarbon comprises natural gas.

19. The process according to claim 1, wherein the reductant comprises at least two reductants selected from hydrogen gas, carbon monoxide gas, or natural gas.

20. The process according to claim 1, wherein the metal compound particles comprise fine particle coal waste from a mine or a mining process.

21. The process according to claim 1, wherein the metal compound particles comprise coal ash waste.

22. The process according to claim 1, wherein the metal compound particles have a residence time less than 10 seconds in the ultra-high temperature reaction zone.

* * * * *